US007958623B2

(12) United States Patent
Annis et al.

(10) Patent No.: US 7,958,623 B2
(45) Date of Patent: Jun. 14, 2011

(54) METHOD OF MANUFACTURING A CURRENT SWITCH MAGNETIC INTENSIFIER

(75) Inventors: Jeffrey Ramsey Annis, Waukesha, WI (US); Robert Alfred Duchrow, Menomonee Falls, WI (US); Theodore John Houck, III, Milwaukee, WI (US); James Peter Miller, Waukesha, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 139 days.

(21) Appl. No.: 12/338,168

(22) Filed: Dec. 18, 2008

(65) Prior Publication Data

US 2009/0094820 A1 Apr. 16, 2009

Related U.S. Application Data

(62) Division of application No. 11/526,040, filed on Sep. 22, 2006, now Pat. No. 7,551,050.

(51) Int. Cl.
*H01H 11/00* (2006.01)
*H01H 65/00* (2006.01)

(52) U.S. Cl. ..... 29/622; 29/602.1

(58) Field of Classification Search ..... 29/622, 29/602.1; 218/22, 27, 32–34, 36, 40, 148; 335/16, 35, 172

See application file for complete search history.

(56) References Cited

U.S. PATENT DOCUMENTS

| | | | |
|---|---|---|---|
| 2,467,937 | A | 4/1949 | Jackson |
| 4,237,355 | A | 12/1980 | Fechant et al. |
| 4,375,021 | A | 2/1983 | Pardini et al. |
| 4,451,718 | A | 5/1984 | Yamagata et al. |
| 4,470,027 | A | 9/1984 | Link et al. |
| 4,618,748 | A | 10/1986 | Mueller |
| 4,642,428 | A | 2/1987 | Yoshiyasu et al. |
| 4,654,490 | A | 3/1987 | Leone et al. |
| 4,654,491 | A | 3/1987 | Maier et al. |
| 4,656,446 | A | 4/1987 | Chien et al. |
| 4,689,588 | A | 8/1987 | Murata et al. |

(Continued)

FOREIGN PATENT DOCUMENTS

EP 1998349 3/2008

OTHER PUBLICATIONS

European Search Report.

*Primary Examiner* — Thiem Phan

(74) *Attorney, Agent, or Firm* — Boyle Fredrickson LLP; Alexander R. Kuszewski; John M. Miller

(57) ABSTRACT

A method of manufacturing a current switch magnetic intensifier that is constructed to be secured in generally close proximity to the stationary contact of the current switch. During termination of the communication of power through the contactor assembly, the magnetic intensifier accentuates a magnetic field associated with a stationary contact and increases the magnitude of a magnetic force directed to the arc arrestor. The intensifier is fitted proximate the stationary contact so that a pair of arc rails extend beyond the stationary contact such that a force of a magnetic field generated by the contactor magnetic intensified is directed in a common direction with a direction of reduced resistance of the pair of arc rails to ensure efficient, repeatable, and expedient transfer of a circuit termination arc to the arc arrestor.

5 Claims, 5 Drawing Sheets

U.S. PATENT DOCUMENTS

| | | | | |
|---|---|---|---|---|
| 4,743,720 | A | | 5/1988 | Tekeuchi et al. |
| 4,950,853 | A | | 8/1990 | Crookston |
| 5,075,520 | A | | 12/1991 | Mueller et al. |
| 5,097,104 | A | | 3/1992 | Weichert |
| 5,206,614 | A | | 4/1993 | Carothers |
| 5,210,385 | A | | 5/1993 | Morel et al. |
| 5,323,130 | A | | 6/1994 | Arnold |
| 5,475,193 | A | | 12/1995 | Perdoncin |
| 5,546,061 | A | | 8/1996 | Okabayashi et al. |
| 5,548,258 | A | | 8/1996 | Kuboyama et al. |
| 5,569,894 | A | | 10/1996 | Uchida et al. |
| 5,583,328 | A | * | 12/1996 | Mitsuhashi et al. ..... 218/33 |
| 5,589,672 | A | | 12/1996 | Uchida et al. |
| 5,744,772 | A | | 4/1998 | Fasano |
| 5,807,130 | A | | 9/1998 | Miller et al. |
| 5,837,954 | A | | 11/1998 | Asakawa et al. |
| 6,060,674 | A | | 5/2000 | Malingowski et al. |
| 6,259,341 | B1 | | 7/2001 | Juds et al. |
| 6,265,685 | B1 | | 7/2001 | Faure et al. |
| 6,281,459 | B1 | | 8/2001 | Munsch et al. |
| 6,297,465 | B1 | | 10/2001 | Groves et al. |
| 6,300,586 | B1 | | 10/2001 | Doughty et al. |
| 6,373,014 | B1 | | 4/2002 | Mitsuhashi et al. |
| 6,384,702 | B1 | | 5/2002 | Smith et al. |
| 6,392,512 | B1 | | 5/2002 | Ferree et al. |
| 6,411,489 | B1 | | 6/2002 | Kappel et al. |
| 6,493,202 | B2 | | 12/2002 | Kappel et al. |
| 6,518,530 | B2 | | 2/2003 | Heins et al. |
| 6,703,575 | B1 | | 3/2004 | Yamamoto |
| 6,958,671 | B2 | | 10/2005 | Chen et al. |
| 7,081,596 | B2 | | 7/2006 | Schneider et al. |
| 2002/0050878 | A1 | | 5/2002 | Ferree et al. |
| 2006/0061920 | A1 | | 3/2006 | Lam |
| 2007/0290775 | A1 | | 12/2007 | McCoy et al. |

* cited by examiner

METHOD OF MANUFACTURING A CURRENT SWITCH MAGNETIC INTENSIFIER

CROSS-REFERENCE TO RELATED APPLICATION

This application is a divisional application and claims priority to U.S. Patent application Ser. No. 11/526,040 filed on Sep. 22, 2006 now U.S. Pat. No. 7,551,050 titled "Contactor Assembly with Arc Steering System" the disclosure of which is incorporated herein.

BACKGROUND OF THE INVENTION

The present invention is directed to electrical contactors and, more particularly, to an arc steering system for such contactors.

A contactor or circuit breaker is a type of current interrupting switch capable of substantially limiting the duration and the intensity of current flowing in a circuit experiencing a short circuit fault. To limit the duration and the intensity of short-circuit currents, a circuit breaker quickly separates the contacts of the circuit breaker. The separation of the contacts while electrical current is flowing through the contactor results in an arc being formed between the contacts of the contactor. Prolonged arcing between the contacts can damage the mating surfaces of the contacts, can damage structures adjacent the contactor, and/or can result in the welding together of the contacts.

Arc damage to the mating surfaces of the contacts detrimentally affects the life of the contactor as well as the continued operability of the contactor. Irregularities in the surface of the contacts caused by arc damage results in contacts that do not fully close in a coplanar manner and in separations between the current carrying surfaces of the contacts when the contacts are closed. These irregularities mean that current that is communicated through the contactor is carried over a smaller surface area thereby generating localized current concentrations and thermal gradients in the contacts of the contactor assembly. Arcing can also cause irregularities that protrude above the preferably planar mating surfaces of the contacts. These irregularities tend to attract subsequent circuit termination arcs that further degrade the mating surface of the contact. Accordingly, during a short circuit condition, it is desirable to not only quickly separate the contacts but also to quickly transfer any resultant arc away from the contacts.

Among the devices for achieving desired quenching of the arc, the most typical is an arc arrestor which has an arc chute generally aligned along a given number of superimposed ferromagnetic plates. The plates are generally separated from one another and provided with projections or horns that extend toward the path of the arc drawn between the contacts. The plate configuration draws the arc into the arc chute where it is cooled and split up into a plurality of individual smaller arcs, or arclets. However, such a configuration allows the arc to maintain engagement with the contacts until the contacts are sufficiently separated that the resistance between the contacts is greater than the resistance between one contact and a plate of the arc arrestor. Accordingly, although such an arc arrestor aims to quickly quench a circuit termination arc, such arc arrestors inadequately address expedient transfer of the arc away from the contacts.

Still others have attempted to improve the transfer of the arc from the contacts to the arc arrestor through implementation of a slot motor magnet or a magnetic intensifier positioned proximate one of the contacts of the contactor assembly. As current flows through the contacts, a slot motor magnet generates a magnetic force on the arc that is directed toward the arc arrestor. Thus, during separation of the contacts, the magnetic field generated by the slot motor magnet directs the resultant arc toward the arc arrestor.

Such magnetic intensifiers occasionally result in the arc being attracted to the conductive material of the slot motor magnet damaging the slot motor assembly and possibly delaying movement of the arc away from the contacts. Others have attempted to prevent arcing to the slot motor magnet by encasing the magnet material of the slot motor magnet in a non-conductive material. Unfortunately, such modification increases the distance between the slot motor magnetic material and the contactor thereby reducing the magnitude of the magnetic force associated with the slot motor magnet. Accordingly, although such a modification minimizes the potential of arc attraction with the conductive material of the slot motor magnet, such modification also detrimentally affects the desired magnetic effect of the slot motor magnet.

SUMMARY OF THE INVENTION

The present invention provides a contactor with a slot motor magnet that rather that encase the slot motor magnet in an insulator and moving it away from the arc, moves the slot motor structure closer to the arc using at least one wing wrapping up along a side of the contact. The wing is designed to attract the arc and to promote movement of the arc toward the suppressor. A combination of the shape of the wing to promote arc movement and the increased strength of the magnetic field provided by the wing, serves to minimize arc damage to the contact.

Specifically then, the present invention provides a contactor assembly that includes a stationary contact, an arc contact, an arc arrestor, and a magnetic intensifier. The magnetic intensifier is constructed to be secured in generally close proximity to the stationary contact. During communication of power through the contactor assembly, the magnetic intensifier accentuates a magnetic field associated with the stationary contact and increases the magnitude of a magnetic force directed toward the arc arrestor. A pair of arc guides extends along the magnetic intensifier and, cooperatively with the magnetic force, insures efficient, repeatable, and expedient transfer of a circuit termination arc to the arc arrestor.

Therefore, in accordance with one aspect of the present invention, a magnetic intensifier for use in a contactor having a pair of electrical contacts is disclosed. A pair of electrical contacts separates along an axis and produces an arc along the axis between front surfaces of the contacts. At least one contact provides a turnback wherein current to the contact faces along at least a partial loop passing in part behind the contact. The magnetic intensifier includes a magnetic body having a base fitting behind the one contact and at least one wing wrapping about a side of the contact to concentrate magnetic flux formed by the partial loop.

In accordance with another aspect of the present invention, a contactor assembly having a stationary contact, an arc contact, and a magnetic field intensifier is disclosed. The arc contact engages the stationary contact and is constructed to initiate and terminate current communication through the contactor assembly. A plurality of plates are generally aligned along a travel path of the arc contact and constructed to quench an arc generated between the arc contact and the stationary contact. The magnetic field intensifier is constructed to generate a magnetic force with a direction toward the plurality of plates. At least one arm extends from the magnetic field intensifier along a side of the stationary contact that is generally transverse to a contact face of the stationary contact so that at least a portion of a tapered end extends beyond the contact face of the stationary contact.

According to a further aspect of the present invention, a method of manufacturing a contactor magnetic intensifier is disclosed. The method includes cutting a regular trapezoidal body of a magnetic material. The trapezoidal body is folded along fold lines perpendicular to its parallel sides to bound a central base flanked by a pair of upstanding arc rails. The base is fitted against the underside of a stationary contact so that the arc rails extend upward on each side of the stationary contact such that a force of a magnetic field generated by the contactor magnetic intensifier is directed in a common direction with a direction of reduced resistance of the pair of arc rails.

Various other features, aspects and advantages of the present invention will be made apparent from the following descriptions of the drawings.

BRIEF DESCRIPTION OF THE DRAWINGS

The drawings illustrate one preferred embodiment presently contemplated for carrying out the invention. In the drawings.

DETAILED DESCRIPTION OF THE PREFERRED EMBODIMENT

Figure 1:
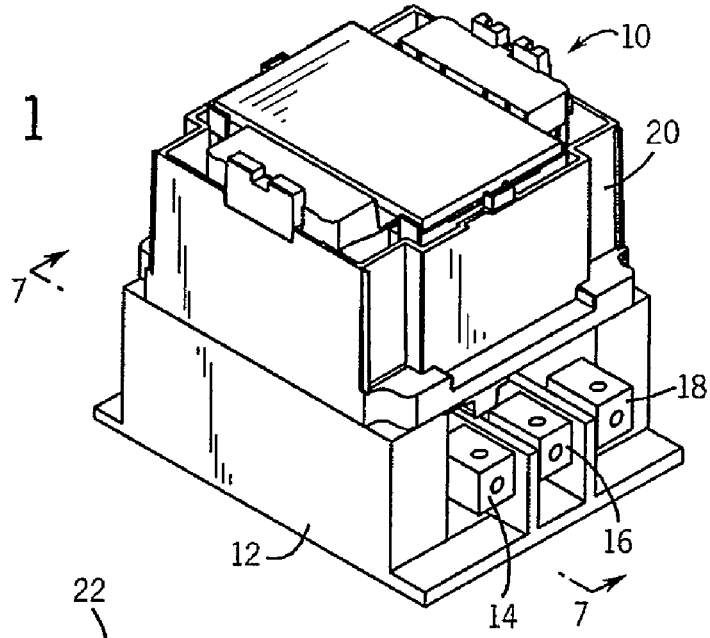
FIG. 1 is perspective view of a three-phase contactor assembly according to the present invention.

FIG. 1 shows an exemplary circuit interrupter or contactor assembly 10 according to the present invention. Contactor assembly 10 includes a housing 12 having a plurality of connections 14, 14', 16, 16', 18, and 18' passing therethrough. Understandably, it is appreciated that, as shown, contactor assembly 10 is configured as a three-phase contactor assembly and that other contactor assembly configurations, such as single phase, are envisioned and within the scope of the claims. It is recognized that the present invention is applicable for contactor assemblies having one contactor to a plurality of contactors, including more than three.

Figure 2:
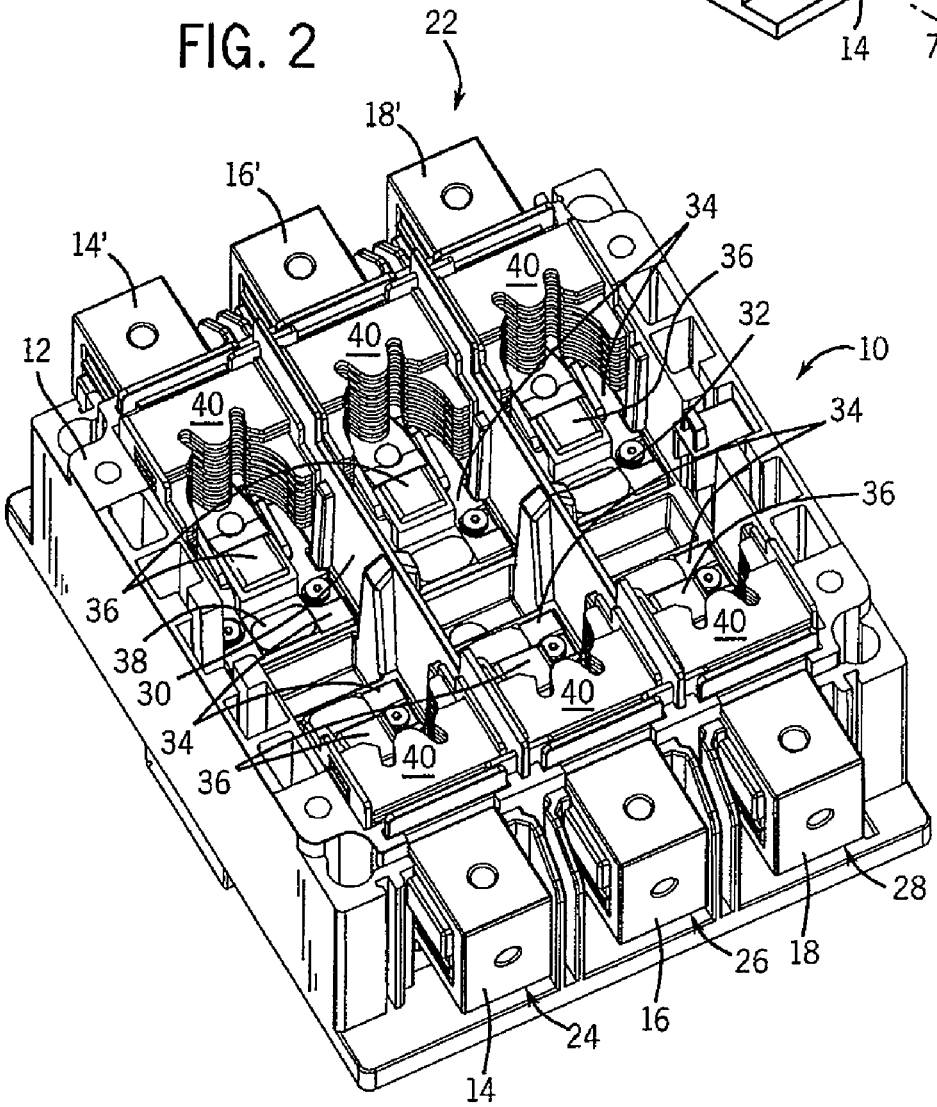
FIG. 2 is a top perspective view of the contactor assembly shown in FIG. 1 with a cover removed therefrom.

Cover 20 is constructed to engage housing 12 and generally encloses the electrical componentry disposed therebehind. As shown in FIG. 2, removing cover 20 from housing 12 exposes a fixed portion 22 of a plurality of severable electrical circuits 24, 26, 28 between connectors 14, 14'; 16, 16' and 18, 18'. Housing 12 includes a plurality of upstanding walls 30, 32 configured to isolate the conductive components of adjacent circuits 24, 26, 28. Each circuit 24, 26, 28 includes at least one stationary contact 34 electrically connected to at least one of connectors 14, 14', 16, 16', 18, 18'. Each stationary contact 34 includes a stationary arc contact or arc contact 36 and a stationary carry contact or carry contact 38. An arc arrestor 40 is positioned proximate each of the arc contacts 36 and is constructed to quench a circuit termination arc that is established at arc contact 36.

Figure 3:
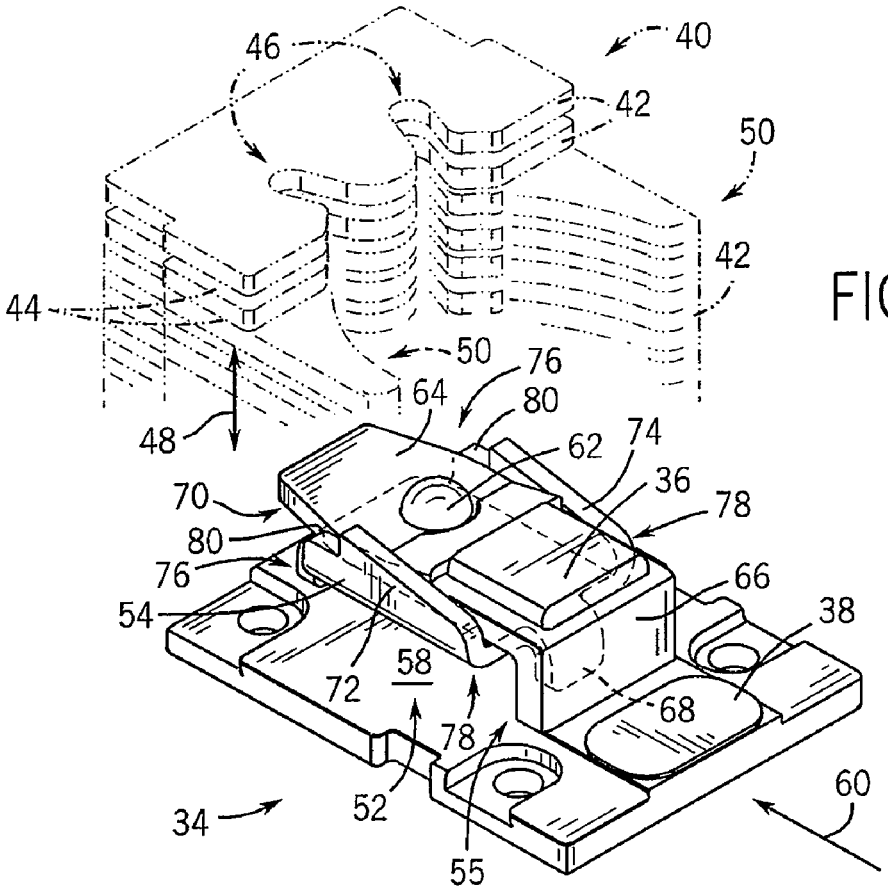
FIG. 3 is a perspective view of a stationary contact of the contactor assembly shown in FIG. 2.

As shown in FIG. 3, arc arrestor 40 includes a plurality of plates 42 that are constructed to be positioned in relatively close proximity to stationary contact 34. A gap 44 is formed between adjacent plates 42 such that, during quenching of a current termination arc, the current termination arc is divided into a plurality of arclets which are formed across gaps 44 between adjacent plates 42. The division of the current termination arc into a plurality of arclets reduces the temperature associated with the circuit termination arc and thereby encourages the collapse of the circuit termination arc.

A pair of channels 46 extends a length, indicated by arrow 48, of arc arrestor 40 and is configured to further enhance cooling of the arc arrestor. A plurality of optional arms 50 extends from a selected number of plates 42 and is configured to generally flank an upstanding portion 55 of stationary contact 34.

Contact 36 is positioned on top of a turnback 56 which provides a looping path of current from base 58 communicating and supporting the carry contact 36 to a cantilevered horizontal portion 64 supporting the contact 36. A vertical portion 66 of turnback 56 offsets horizontal portion 64 of turnback 56 from base 58.

A magnetic intensifier 54 is positioned between a turnback 56 and the base 58 of stationary contact 34. Passage of current through turnback 56 and base 58 of stationary contact 52 generates a magnetic force on an arc having a magnitude oriented generally in the direction indicated by arrow 60. Magnetic intensifier 54 is preferably a ferromagnetic material and serves to concentrate the magnetic field generated by current flow through the turnback 56 and thereby increases the magnitude of magnetic force 60 and maintains the same direction thereof. Alternatively, intensifier 54 could be constructed of the nonconductive ferromagnetic material such as a ceramic magnetic. A rivet 62 secures magnetic intensifier 54 to a horizontal portion 64 of turnback 56. An arm 68 extends from magnetic intensifier 54 toward base 58 and ensures snug engagement of magnetic intensifier 54 within an underside 70 of horizontal portion 64 of turnback 56.

A pair of projections, arms, ramps, or wings 72, 74 extend upward from magnetic intensifier 54 flanking horizontal portion 64 of turnback 56 to be positioned about opposite sides of arc contact 36. The wings 72, 74 extend between a first end 76 and a second end 78 of magnetic intensifier 54 providing a continuous magnetic path. The upper surface of each wing 72 and 74 provides a ramp with sharpened edges sloping upward as one moves away from the arm 68. A notch 80 is formed in wings 72, 74 proximate first ends 76 nearest the arc arrestor 40. As will be described further below with respect to FIGS. 8-10, wings 72, 74 ensure the repeatable transfer of a circuit termination arc away from arc contact 36.

Figure 4:
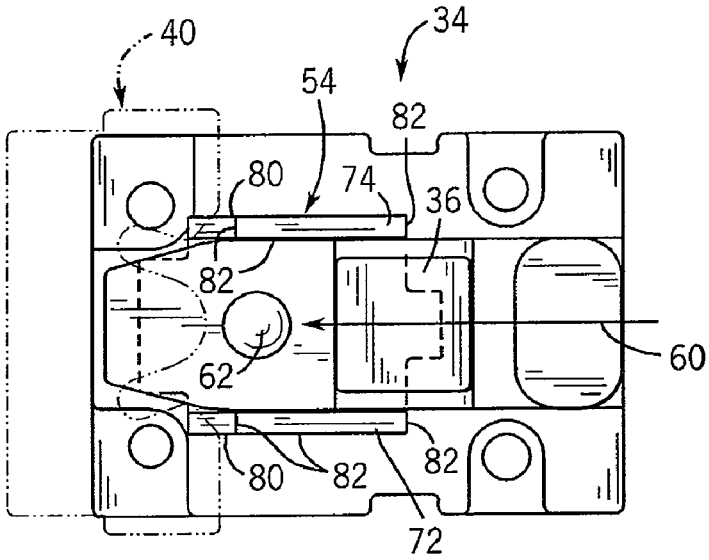
FIG. 4 is a top plan view of the stationary contact shown in FIG. 3.

As shown in FIG. 4, notches 80 of wings 72, 74 allow the relatively close engagement of stationary contact 34 with arc arrestor 40. Wings 72, 74 include a number of corners 82 that are generally positioned between arc contact 36 and arc arrestor 40. Corners 82, the wrapping of wings 72 and 74, and the amplification of magnetic force 60 cooperatively ensure the efficient and repeatable communication of a circuit termination arc away from arc contact 36 and toward arc arrestor 40. Additionally, the relatively close positioning of wings 72, 74 between arc contact 36 and arc arrestor 40 provide assist in the expedient transfer of a circuit termination arc from arc contact 36.

Figure 5:
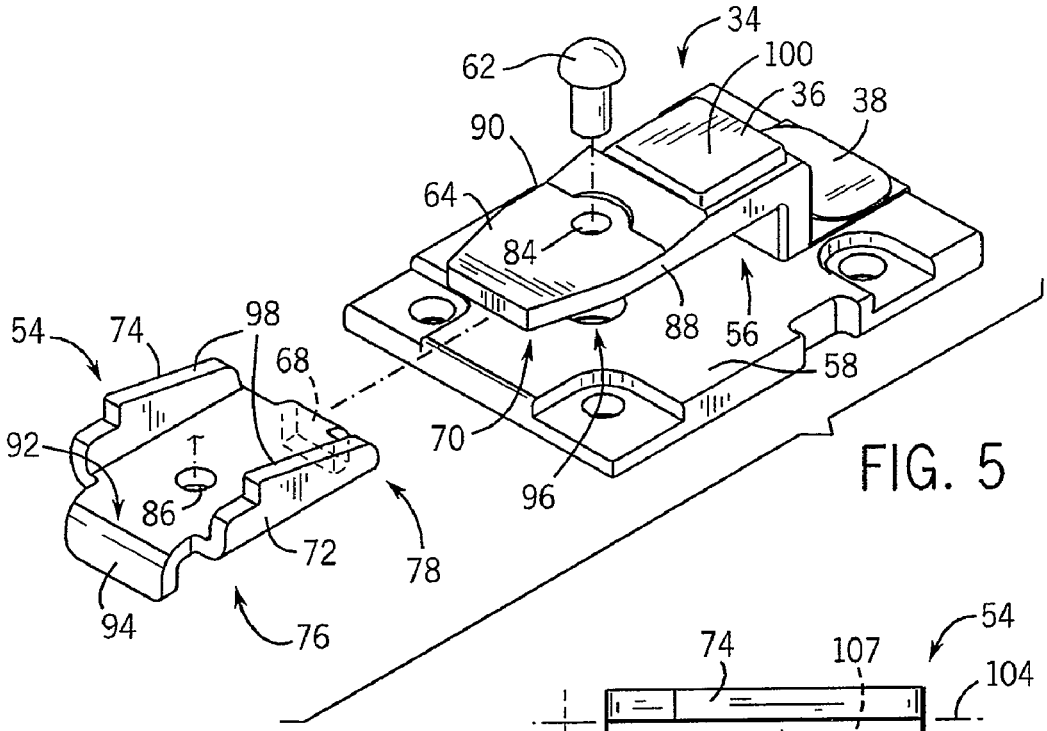
FIG. 5 is a perspective view of the stationary contact shown in FIG. 3 with the magnetic field intensifier removed therefrom.

As shown in FIG. 5, horizontal portion 64 of turnback 56 of stationary contact 34 includes an opening or hole 84 formed therein. A hole or recess 86 is also formed in magnetic intensifier 54 and constructed to allow fastening of the magnetic intensifier to horizontal portion 64 of turnback 56 via rivet 62. Understandably, other fastening or securing means such as crimping or screwing are envisioned and within the scope of the claims. It is further appreciated to simply friction secure magnetic intensifier 54 to turnback 56 through friction fitting such as with arm 68 or like structure. Wings 72, 74 are constructed to generally flank and extend above a pair of sides 88, 90 of horizontal portion 64 of turnback 56. Upper surface 92 of magnetic intensifier 54 snuggly engages underside 70 of turnback 56. Rivet 62, arm 68, and another arm 94 ensure the secure engagement of magnetic intensifier 54 within a space 96 between horizontal portion 64 of turnback 56 and base 58 of stationary contact 34. As shown in FIG. 5, when magnetic intensifier 54 is disposed within space 96, wings 72, 74 each form a ramp 98 which gradually extends above a face 100 of arc contact 36 between first end 76 and second end 78 of magnetic intensifier 54. As described further below, the construction of ramps 98 provide quick and repeatable separation of a circuit termination arc from arc contact 36.

Figure 6:
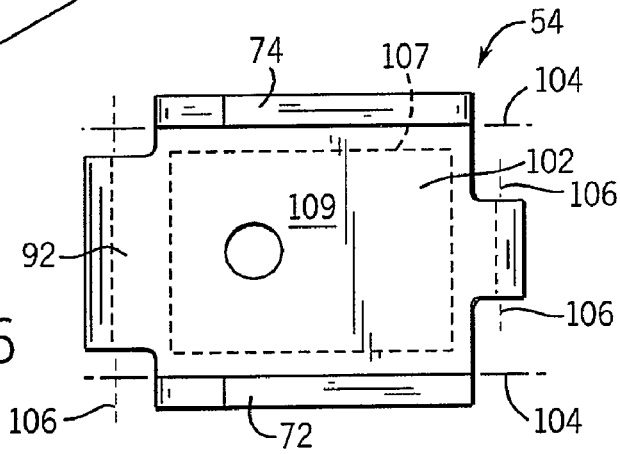
FIG. 6 is a plan view of the magnetic field intensifier shown in FIG. 5.

Referring to FIG. 6, stationary contact 34 includes a generally regular trapezoidal body 102 wound to form wings 72, 74. Body 102 is formed of a magnetic material, a ferromagnetic, or a rare earth material. The trapezoidal body is folded along fold lines 104, 106 that are generally perpendicular to one another. Wings 72, 74 form a pair of upstanding arc rails which generally flank a central portion 109 of base body 102. Positioning upper surface 92 of magnetic intensifier 54 adjacent underside 70 of stationary contact 34 generates a magnetic field force that is directed in a common direction with a direction of reduced resistance of wings 72, 74 as determined by a comparison of the distance between the movable arc contact and the stationary arc contact and the movable arc contact and the wings 72, 74. Optionally, a magnet 107 may be attached to the underside of magnetic intensifier 54 to further boost the magnetic field that serves to move the arc into the arc arrestor 40.

Figure 7:
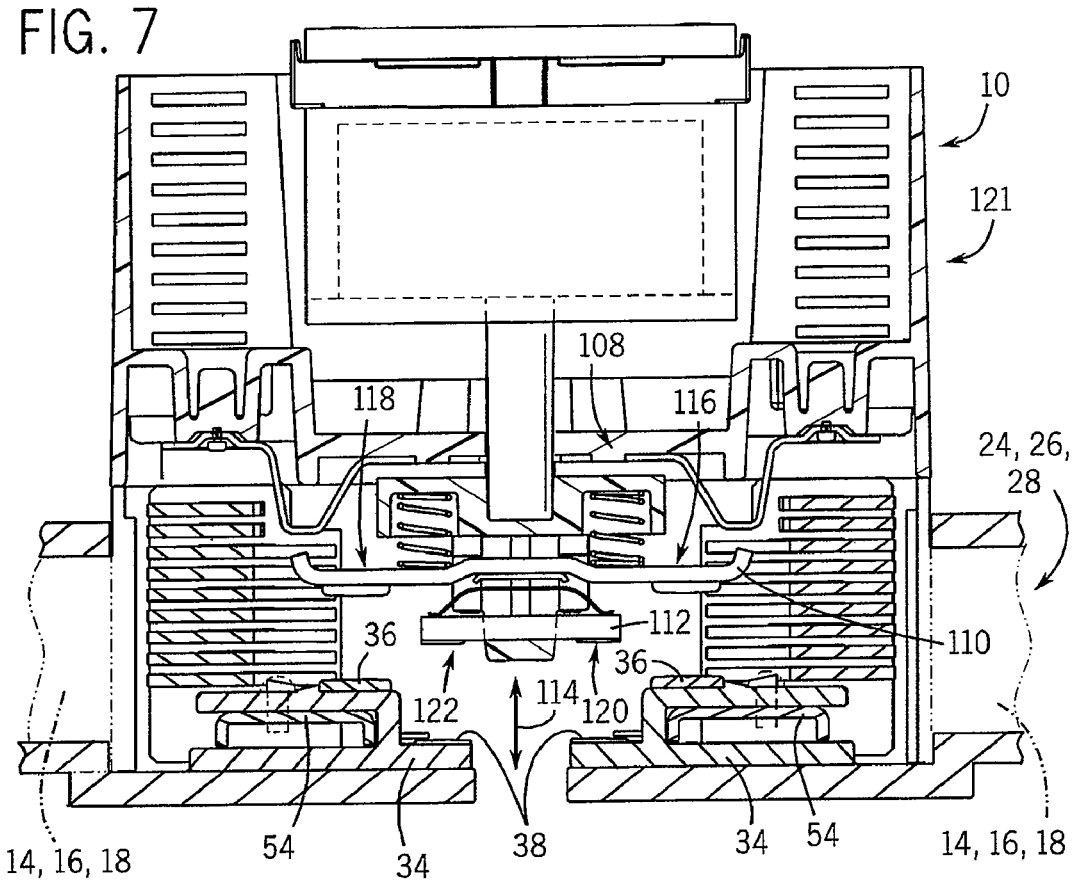
FIG. 7 is a cross-sectional elevational view of the contactor assembly taken along line 6-6 shown in FIG. 1.

FIG. 7 is an elevational cross-sectional view of circuit 24, 26, 28 of contactor assembly 10. FIGS. 7-11 depict an operational sequence of the movable elements of contactor assembly 10. Understandably, it is appreciated that contactor assembly 10 is constructed to selectively close an electrical circuit as well as automatically sever the electrical circuit when a ground fault is detected or when a user desires to sever the electrical circuit.

Figure 8:
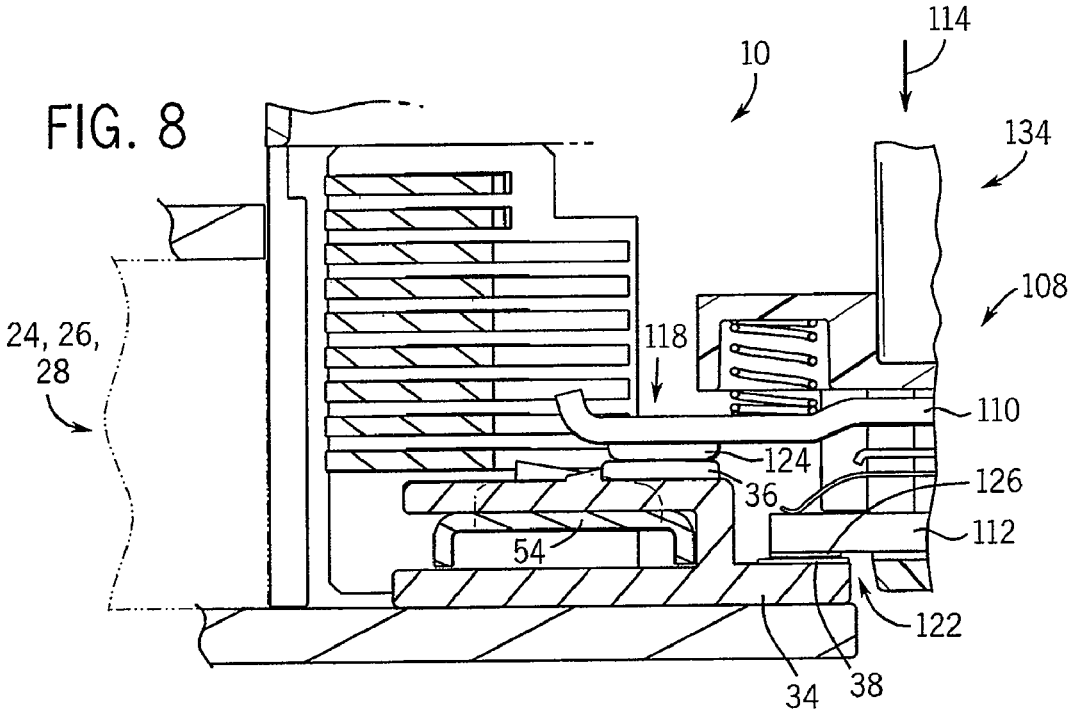
FIG. 8 is an elevational view of one side of the contactor assembly shown in FIG. 7 with the carry contacts and the arc contacts positioned to communicate current through the contactor assembly.

Referring to FIG. 7, a moveable contact assembly 108 includes an arc contact bridge 110 and a carry contact bridge 112 that are moveably connected to contactor assembly 10. Arc contact bridge 110 and carry contact bridge 112 are moveable in a direction, indicated by arrow 114 such that opposing ends 116, 118 of arc contact bridge 110 engage arc contacts 36 of stationary contacts 34 and opposing ends 120, 122 of carry contact bridge 112 engage adjacent carry contacts 38. As shown in FIG. 7, moveable contact assembly 108 is an open or nonconducting position 121 wherein electrical current is not communicated through the contactor assembly. As shown in FIG. 8, when it is desired to communicate power through contactor assembly 10, moveable contact assembly 108 is displaced in direction 114 such that arc contact 36 and carry contact 38 of stationary contact 34 electrically engage an arc contact 124 connected to arc contact bridge 110 and a carry contact 126 attached to carry contact bridge 112. Comparing FIGS. 7 and 8, it is shown that moveable contact assembly 108 is movable between the open circuit position shown in FIG. 7 and a closed or conducting position 134 shown in FIG. 8. As shown in FIG. 8, when desired or during normal power providing conditions, the movable arc contact 124 and movable carry contact 126 engage the stationary arc contact 36 and stationary carry contact 38. Accordingly, electrical power is communicated through both carry contact bridge 112 and arc contact bridge 110 of contactor assembly 10 when the contactor assembly is closed.

Figure 9:
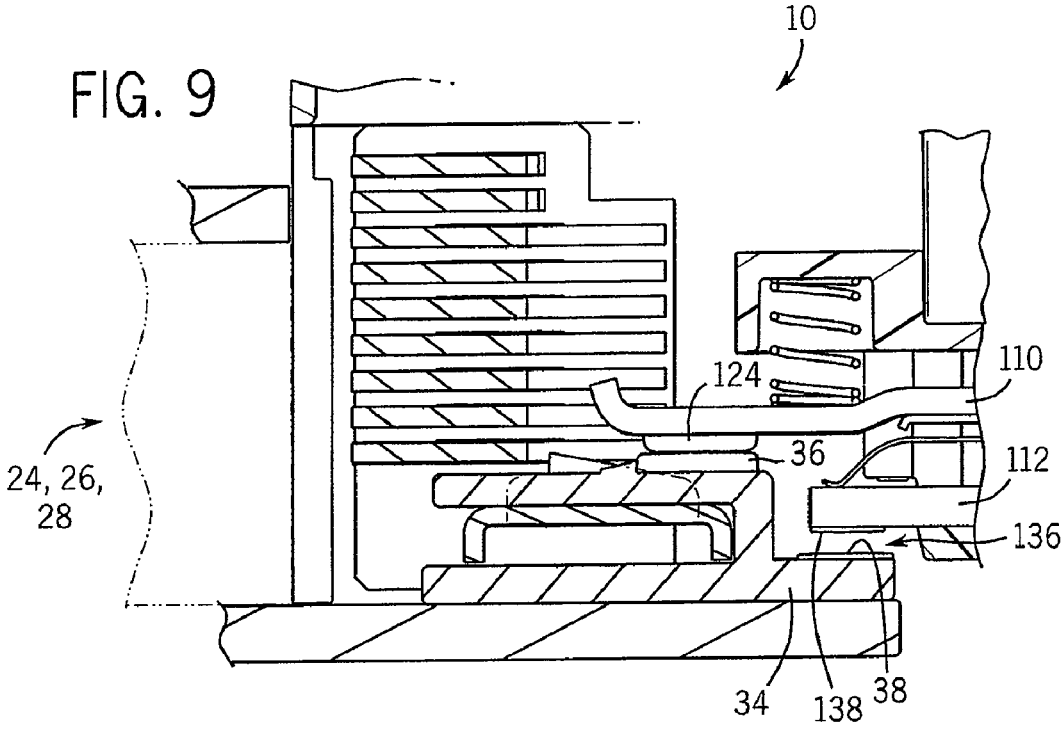
FIG. 9 is a view similar to that shown in FIG. 8 with the carry contacts separated so that current is only communicated through the arc contacts.

As shown in FIG. 9, when a non-conducting or open configuration of contactor assembly 10 is desired or a ground fault condition occurs, carry contact bridge 112 disengages or separates from carry contact 38 of stationary contact 34 thereby forming a gap 136 between stationary carry contact 38 and each of the moveable carry contacts 138. Current is still communicated through contactor assembly 10 via the engagement of arc contact 36 of stationary contact 34 and moveable arc contact 124 attached to arc contact bridge 110. Such a construction ensures that, during opening, or severing of the electrical connection, current is allowed to flow through arc contact bridge 110 after isolation of the carry contact bridge thereby ensuring any resultant circuit termination arc is formed between arc contacts 36, 124. Such operation maintains the mechanical and electrical integrity and operability of carry contacts 38, 138.

Figure 10:
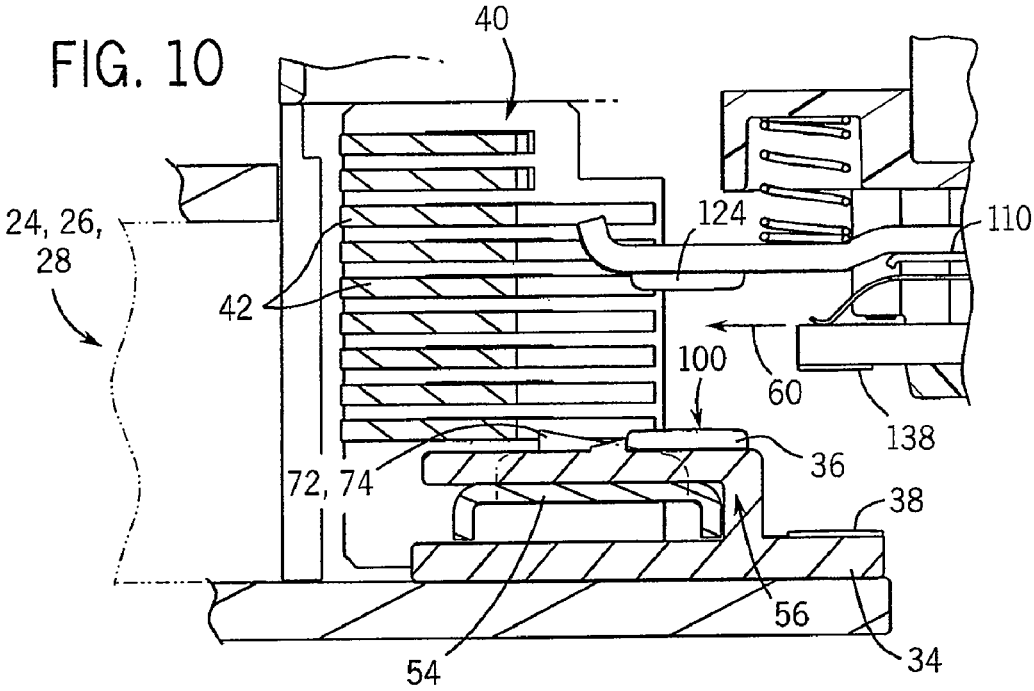
FIG. 10 is a view similar to that shown in FIG. 9 with the movable arc and carry contacts moved away from the stationary arc and carry contacts to prevent the communication of current through the contactor assembly.

As shown in FIG. 10, opening of the circuit 24, 26, 28 is achieved with the translation of moveable arc contact 124 out of engagement with stationary arc contact 36. Separation of stationary carry contact 38 and moveable carry contact 138 prior to disengagement of stationary arc contact 36 and moveable arc contact 124 ensures that any circuit termination resultant arc is generated proximate arc contacts 36, 124. The shape of turnback 56 of stationary contact 34 generates electromagnetic magnetic force 60 directed toward arc arrestor such that the arc is broken up into a plurality of arclets between adjacent plates 42 of arc arrestor 40. Magnetic intensifier 54 increases the magnitude of force 60 toward arrestor 40 and ensures expedient transfer of the arc from stationary arc contact 36 to the plates 42 of arc arrestor 40.

Figure 11:
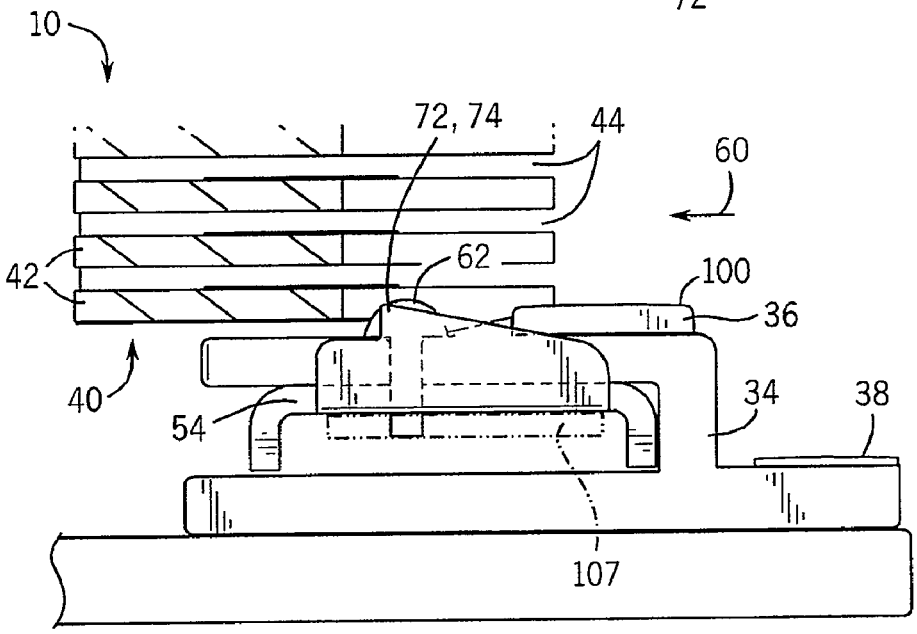
FIG. 11 is an elevational view of the stationary contact and magnetic field intensifier positioned proximate the arc arrestor of the contactor assembly shown in FIG. 10.

Referring to FIG. 11, wings 72, 74 of magnetic intensifier 54 extend above contact face 100 of stationary arc contact 36 and are constructed to attract a circuit termination arc away from the stationary arc contact 36. Accordingly, magnetic intensifier 54 is constructed to accentuate or intensify the magnitude of magnetic force 60 associated with turnback 56 in addition to providing an arc guiding or steering function for any resultant circuit termination arc away from contact face 100 of arc contact 36 toward arrestor 40. As such, regardless of whether a circuit termination arc propagates to wing 72, 74 or rivet 62, magnetic intensifier 54, in amplifying magnetic force 60, assists in the expedient transfer of a circuit termination arc from contact face 100 thereby maintaining the mechanical and electrical integrity of the stationary arc contact 36. Optional magnet 107 further enhances the arc directing ability of contactor assembly 10. Understandably, intensifier 54 and magnet 107 could be constructed of magnetically reactive materials, current magnetically reactive materials, simple magnetic materials such as natural or rare earth magnetic materials, ceramic based magnetic materials. Accordingly, a contactor assembly constructed according to the present invention is constructed to withstand greater operating power and is less susceptible to arc termination and arc contact degradation.

Therefore, a contactor assembly according to the present includes a stationary contact, an arc contact, an arc arrestor, and a magnetic intensifier. The magnetic intensifier is constructed to be secured in generally close proximity to the stationary contact. During communication of power through the contactor assembly, the magnetic intensifier accentuates a magnetic field associated with the stationary contact and increases the magnitude of a magnetic force directed to the arc arrestor. A pair of arc guides extends along the magnetic intensifier and, cooperatively with the magnetic force, ensures efficient, repeatable, and expedient transfer of a circuit termination arc to the arc arrestor. Such a construction increases the operable range and lifecycle of the contactor by reducing the damage associated with propagation of the circuit termination arc.

One embodiment of the invention includes a magnetic intensifier for use in a contactor having a pair of electrical contacts separating along an axis and producing an arc along the axis between front surfaces of the contacts. At least one contact provides a turn back wherein current to the contact passes along at least a partial loop passing in part behind the contact. The intensifier includes a magnetic body having a base fitting behind the one contact and at least one wing wrapping about a side of the contact to concentrate magnetic flux formed by the partial loop.

Another embodiment of the invention includes a contactor assembly having a stationary contact, and arc contact, a plurality of plates, and a magnetic field intensifier. The arc contact is for engaging the stationary contact and constructed to initiate and terminate current communication through the contactor assembly. The plurality of plates are generally aligned along a travel path of the arc contact and constructed to quench an arc generated between the arc contact and the stationary contact. The magnetic field intensifier is constructed to generate a magnetic force with a direction toward the plurality of plates. At least one arm having a tapered end extends from the magnetic field intensifier along a side of the stationary contact that is generally transverse to a contact face of the stationary contact so that at least a portion of the tapered end extends beyond the contact face of the stationary contact.

A further embodiment of the invention is a method of manufacturing a contactor magnetic intensifier which includes the steps of cutting a regular trapezoidal body of a magnetic material, folding the trapezoidal body, and fitting the base against the underside of a stationary contact. The trapezoidal body is folded along fold lines that are perpendicular to parallel sides of the body to bound a central base flanked by a pair of upstanding arc rails. The base is fitted against the underside of the stationary contact so that the arc rails extend upward on each side of the stationary contact such that a force of a magnetic field generated by the contactor magnetic intensifier is directed in a common direction with a direction of reduced resistance of the pair of arc rails.

Understandably, the present invention has been described above in terms of the preferred embodiment. It is recognized that various alternatives and modifications may be made to these embodiments which are within the scope of the appending claims.

What is claimed is:

1. A method of manufacturing a current switch magnetic intensifier comprising the steps of:

(A) cutting a regular trapezoidal body of a magnetic material;

(B) folding the trapezoidal body along fold lines perpendicular to its parallel sides to bound a central base flanked by a pair of upstanding arc rails;

(C) folding the trapezoidal body along another set of fold lines perpendicular to its parallel sides and in a direction generally opposite to the direction of the upstanding arc rails; and (D) fitting the base proximate a stationary contact so that only the arc rails extend beyond each side of the stationary contact and so that the body can be positionally secured relative to a turnback that supports the stationary contact only by frictionally disposing the body within a passage formed by a turnback and such that a force of a magnetic field generated by the contactor magnetic intensifier is directed in a common direction with a direction of reduced resistance of the pair of arc rails.

2. The method of claim 1 further comprising tapering an end of the arc rails from a first position above a contact face of the stationary contact to a second position closer to the contact face than the first position.

3. The method of claim 2 further comprising forming a notch in each of the pair of arc rails proximate the first position such that a peak of each of the arc rails is located between the notch and the second position.

4. The method of claim 1 further comprising forming a plurality of corners on each of the pair of arc rails.

5. The method of claim 1 further comprising offsetting the fold lines from the ends of the trapezoidal body such that the base is generally aligned along the underside of the stationary contact and offset from a portion of a turnback that supports the stationary contact.

* * * * *